US006210058B1

(12) United States Patent
Kageyama et al.

(10) Patent No.: US 6,210,058 B1
(45) Date of Patent: Apr. 3, 2001

(54) SIDE KNOCK TYPE MECHANICAL PENCIL

(75) Inventors: Hidehei Kageyama; Tomiji Ueki; Yoshihide Mitsuya, all of Kawagoe (JP)

(73) Assignee: Kotobuki & Co., Ltd. (JP)

( * ) Notice: Subject to any disclaimer, the term of this patent is extended or adjusted under 35 U.S.C. 154(b) by 0 days.

(21) Appl. No.: 09/598,961

(22) Filed: Jun. 22, 2000

Related U.S. Application Data

(62) Division of application No. 09/065,520, filed on Apr. 24, 1998, now Pat. No. 6,099,182, which is a continuation of application No. 08/770,300, filed on Dec. 20, 1996, now Pat. No. 5,791,797, which is a continuation of application No. 08/327,549, filed on Oct. 24, 1994, now abandoned.

(30) Foreign Application Priority Data

Jul. 22, 1994 (JP) ..... 6-191293
Sep. 27, 1994 (JP) ..... 6-267965

(51) Int. Cl.[7] ..... B43K 25/00
(52) U.S. Cl. ..... 401/55; 401/62
(58) Field of Search ..... 401/52, 55, 62, 401/65, 66

(56) References Cited

U.S. PATENT DOCUMENTS

| | | | | |
|---|---|---|---|---|
| 1,518,822 | * | 12/1924 | Saadi | 401/99 X |
| 1,866,072 | | 7/1932 | Woelm . | |
| 3,813,176 | | 5/1974 | Kamo . | |
| 3,836,264 | * | 9/1974 | Saito et al. | 401/65 |
| 3,883,253 | | 5/1975 | Naruse et al. . | |
| 3,892,495 | | 7/1975 | Naruse et al. . | |
| 3,945,733 | | 3/1976 | Edel . | |
| 4,270,870 | | 6/1981 | Hashimoto et al. . | |
| 4,381,158 | | 4/1983 | Garganese . | |
| 4,865,479 | | 9/1989 | Doll . | |
| 4,955,739 | | 9/1990 | Kageyama et al. . | |
| 5,062,727 | | 11/1991 | Kageyama et al. . | |
| 5,236,271 | | 8/1993 | Sakaoka . | |
| 5,354,141 | | 10/1994 | Watanabe . | |
| 5,791,797 | * | 8/1998 | Kageyama et al. | 401/52 |
| 6,099,182 | * | 8/1998 | Kageyama et al. | 401/55 |

FOREIGN PATENT DOCUMENTS

| | | | | |
|---|---|---|---|---|
| 1176605 | * | 10/1984 | (CA) | 401/65 |
| 67590 | * | 8/1940 | (CS) | 401/65 |
| 802797 | | 1/1951 | (DE) . | |
| 1020256 | | 11/1957 | (DE) . | |
| 294823 | | 12/1988 | (EP) . | |
| 52-12489 | * | 3/1977 | (JP) | 401/65 |
| 295800 | | 12/1990 | (JP) . | |
| 10899 | | 1/1991 | (JP) . | |
| 4048000 | | 2/1992 | (JP) . | |
| 8810198 | | 12/1988 | (WO) . | |

* cited by examiner

*Primary Examiner*—Gregory L. Huson
*Assistant Examiner*—Peter deVore
(74) *Attorney, Agent, or Firm*—Rothwell, Figg, Ernst & Manbeck, P.C.

(57) ABSTRACT

A side knock type mechanical pencil including a cylindrical shell having a ferrule; a slide member disposed axially movably within the cylindrical shell; a chuck disposed in front of the slide member, with a chuck ring being loosely fitted on the chuck; a chuck spring for urging the chuck backward; and a side knock mechanism provided in the cylindrical shell, the said side knock mechanism comprising a side knock member provided in the cylindrical shell and the slide member, the slide member being movable axially against the backward bias of the chuck spring and having a slant portion for abutment with the side knock member when the side knock member is depressed radially.

80 Claims, 11 Drawing Sheets

SIDE KNOCK TYPE MECHANICAL PENCIL

This application is a divisional application of U.S. Ser. No. 09/065,520 filed Apr. 24, 1998, now U.S. Pat. No. 6,099,182, which is a continuation of U.S. Ser. No. 08/770,300, filed Dec. 20, 1996, now U.S. Pat. No. 5,791,797, which is a continuation of of U.S. Ser. No. 08/327,549, filed Oct. 24, 1994, now abandoned, the entire contents of which are hereby incorporated by reference.

BACKGROUND OF THE INVENTION

1. Field of the Invention

The present invention relates to a side knock type mechanical pencil, particularly a side knock type mechanical pencil provided with a mechanism for the delivery of a rod-like article such as an eraser or the like.

2. Description of the Prior Art

Heretofore, various side knock type mechanical pencils have been proposed such as, for example, the one disclosed in U.S. Pat. No. 3,883,253 and illustrated in FIG. 1 attached hereto. According to this prior art example, a knock lever 22 is mounted within a side hole 21 of a cylindrical shell 20 having a chuck mechanism, and a lead is pushed out by knocking the knock lever 22 with a finger tip of the use while grasping the vicinity of the knock lever. More particularly, upon operation of the knock lever 22, an actuating portion 22*a* thereof comes into abutment with a slant portion 24*a* of a slider 24 provided in an inner tube set 23, thereby causing the inner tube set 23 to move forward along the inner wall surface of the cylindrical cell 20 against a backward biasing force of a spring 25, whereby a chuck 26 is opened to effect delivery of a lead.

In such convention mechanical pencil, however, a side knock mechanism is generally positioned in the grip portion. Therefore, in the case where a grip member formed of an elastic material such as rubber is formed in that portion, the diameter of the grip portion becomes large, so the diameter of a lead tank 27 is set to a size which permits one lead to pass therethrough, and a space for spare leads is formed in the rear portion. Recently, however, there has been proposed a mechanical pencil having in the rear portion thereof a mechanism for the delivery of a rod-like article such as an eraser or the like. In a side knock type mechanical pencil having such a mechanism incorporated therein, there is no space for spare leads in the rear portion thereof; besides, the diameter of the lead tank 27 is required to be made small, and thus it has been difficult to accommodate spare leads.

SUMMARY OF THE INVENTION

It is an object of the present invention to provide a side knock type mechanical pencil having a sufficient space in the rear portion thereof and capable of enlarging the inside diameter of a lead tank and that of a side member, which are limited in length, so as to permit a plurality of spare leads to be received therein and also capable of providing a grip member if necessary.

It is another object of the present invention to provide a side knock type mechanical pencil having a rear-end knock mechanism in addition to a side knock function in order to permit a lead to be pushed out easily in the initial continuous knocking though this is difficult in the side knock operation.

It is a further object of the present invention to provide a side knock type mechanical pencil wherein a slide member as a constituent of a side knock mechanism is formed as a one-piece member to reduce the number of components and cost and facilitate the assembling work.

According to the present invention, in order to achieve the above-mentioned objects, there is provided a side knock type mechanical pencil including a cylindrical shell having a ferrule; a lead tank disposed axially slidably within the cylindrical shell; a chuck disposed at a front end portion of the lead tank, with a chuck ring being loosely fitted on the chuck; a resilient member for urging the chuck backward; and a slide knock mechanism provided in the cylindrical shell, the slide knock mechanism comprising a slide knock member provided in the cylindrical shell and a slide member having a lead inserting through hole formed axially and also having a slant portion for abutment with the side knock member, the slide member being movable axially against the backward biasing force of the resilient member.

Further, according to the present invention, in order to achieve the above-mentioned objects, there is provided a side knock type mechanical pencil including a cylindrical shell having a ferrule; a slide member disposed axially slidably within the cylindrical shell; a chuck disposed at a front end portion of the slide member, with a chuck ring being loosely fitted on the chuck; a resilient member for urging the chuck backward; and a side knock mechanism provided in the cylindrical shell, the side knock mechanism comprising a side knock member provided in the cylindrical shell and the slide member, the slide member being movable axially against the backward biasing force of the resilient member and having a slant portion for abutment with the side knock member and also having a lead inserting through hole formed axially.

By depressing a knock lever as the side knock member, the slide member is moved forward against the backward bias of the resilient member through the slant portion as a knock surface of the slide member to open the chuck and push out a lead. Where required, a rod-like article such as an eraser or the like can be pushed out backward by rotating a rear cap. Further, when continuous knocking is required, the rear end of the mechanical pencil can be knocked, whereby a lead can be pushed out.

DETAILED DESCRIPTION OF THE PREFERRED EMBODIMENTS

Figure 1:
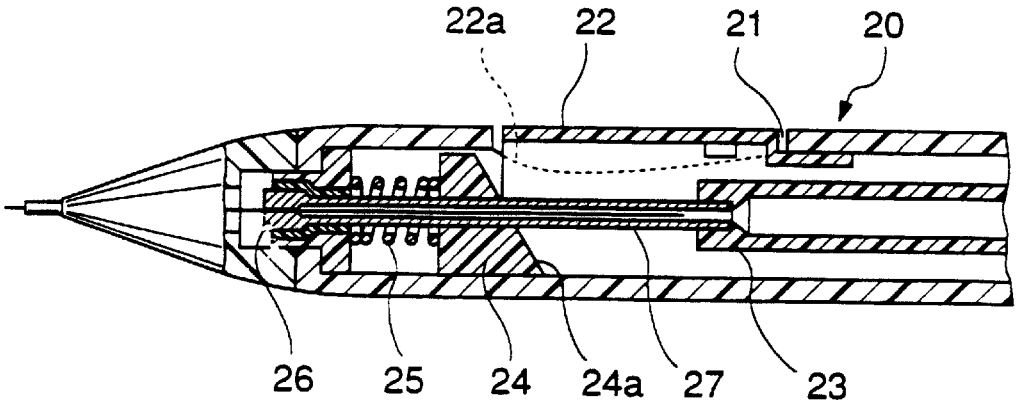
FIG.1 PRIOR ART
FIG. 1 is a sectional view of a conventional side knock type mechanical pencil.

Embodiments of the present invention will now be described in detail with reference to the accompanying drawings.

Embodiment 1

FIGS. 2 to 14 illustrate a mechanical pencil according to embodiment 1 of the present invention, in which knocking operation is performed by side knock and rear-end knock. In those figures, a writing mechanism is provided in the front portion of the interior of a cylindrical shell 1, while in the rear portion thereof is provided an eraser delivery mechanism.

Reference will first be made to the front writing mechanism. Within the cylindrical shell 1 is disposed a lead tank 2 axially slidably, the lead tank 2 having an inside diameter sufficient to receive therein a plurality of leads together. A chuck 3 is press-fitted and fixed into the front end of the lead tank 2, with a chuck ring 4 being loosely fitted on the chuck 3. Further, a sleeve 5 is provided outside the chuck 3, and inside the sleeve 5 is mounted a chuck spring 6 for urging the lead tank 2 backward.

A ferrule 7 having on the inner periphery side thereof a stepped portion 7*a* which serves as a stopper for the chuck ring 4 is threadedly engaged with the front end of the cylindrical shell 1, and within the ferrule 7 are disposed an axially slidable tip pipe 8 and a slider 9 into which is press-fitted and fixed the rear end of the tip pipe 8 and whose inner peripheral portion supports a lead by virtue of a predetermined frictional resistance. Further, a cushion spring 10 for absorbing an excessive writing pressure is mounted between the rear end of the sleeve 5 and the cylindrical shell 1.

The reference numeral 10*a* denotes a return spring mounted between the cylindrical shell 1 and the front end of a slide member 17 which will be described later. The return spring 10*a,* which has a biasing force weaker than that of the chuck spring 6 and urges the slider 17, etc. backward, is advantageous in the following point. If the rear end of the lead tank 2 is in abutment with a stepped portion of the front inner periphery of the slide member 17, there is created a knocking state and the chucking portion at the front end of the chuck 3 is open slightly, thus causing lead slip. Therefore, even if there are variations in the overall length of the lead tank 2, it is necessary in design to keep the rear end of the lead tank 2 slightly spaced from the stepped portion of the front inner periphery of the slide member 17 in order to avoid mutual abutment. In the presence of such a gap, however, it is likely that the slide member 17 will move back and forth by the distance corresponding to the gap. However, since the return spring 10*a* urges the slide member 17 continually backward, there is no fear of such longitudinal slide (wobbling) of the slide member 17.

Figure 4:
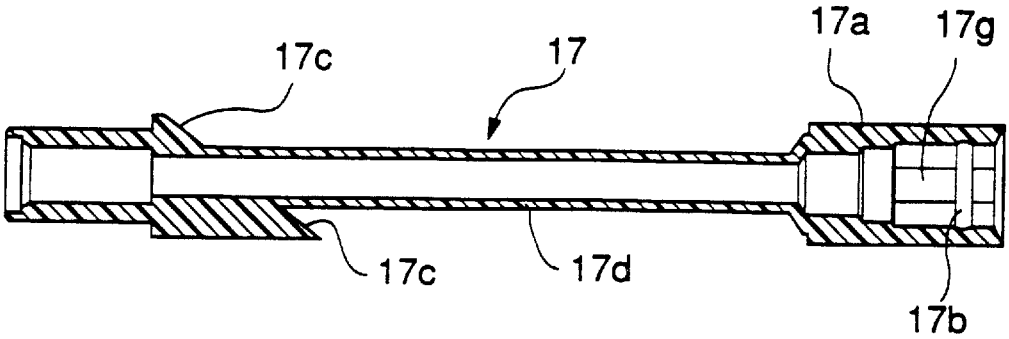
FIG. 4 is a sectional view of the slide member illustrated in FIG. 3.
Figure 5:
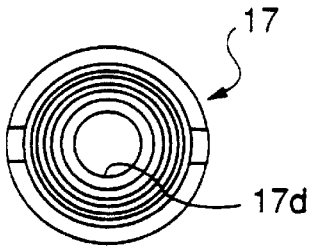
FIG. 5 is a bottom view of the slide member illustrated in FIG. 4.
Figure 6:
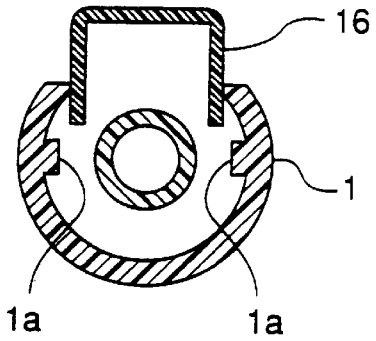
FIG. 6 is a sectional view taken along line A—A in FIG. 2.
Figure 7:
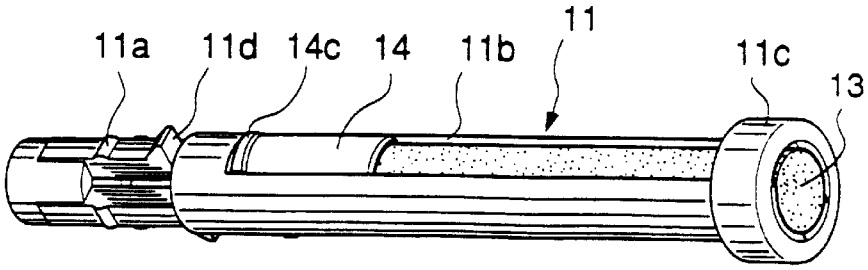
FIG. 7 is a perspective view of a guide cylinder illustrated in FIG. 2, with both eraser and eraser support member inserted therein.
Figure 8:
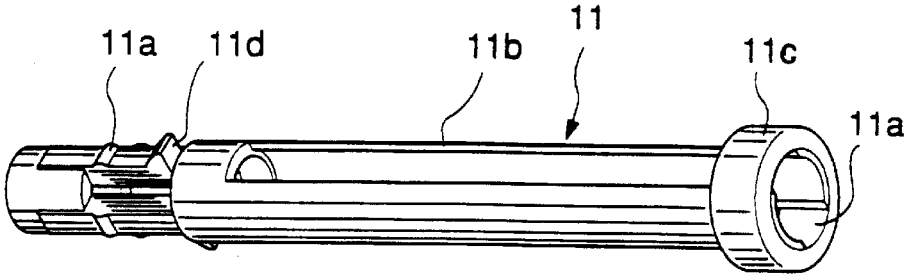
FIG. 8 is a perspective view of only the guide cylinder illustrated in FIG. 7.
Figure 9:
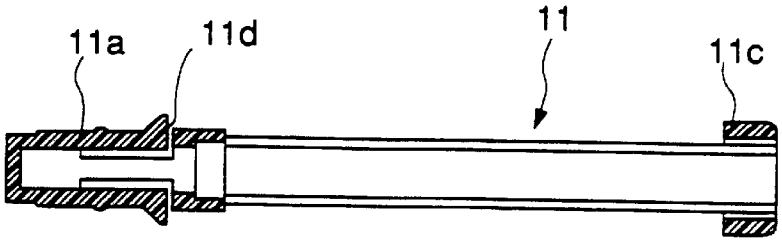
FIG. 9 is a longitudinal sectional view of the guide cylinder illustrated in FIG. 8.

Description is now directed to the eraser delivery mechanism located at the rear portion of the mechanical pencil. A guide cylinder 11 shown in FIGS. 7 to 9 is extractably fitted in a receptacle portion 17*a* of a larger diameter, the receptacle portion 17*a* being formed at the rear portion of the slide member 17 which is shown in FIG. 4. More specifically, an annular groove 17*b* is formed in the inner periphery of the receptacle portion 17*a,* while on the outer periphery of the guide cylinder 11 is formed a ring-like protuberance 11*a* for engagement with the annular groove 17*b.*

The guide cylinder 11 has a pair of slits 11*b* formed axially and opposedly to each other. The slits 11*b* are closed at their rear ends, at which there is formed a large-diameter portion 11*c.* The guide cylinder 11 is inserted axially slidably into a rotatably connected rear cap 12 and is engaged circumferentially with the rear cap, with its rear end side projecting from the rear end of the cap 12.

At the front portion of the guide cylinder 11 are integrally formed a pair of elastic retaining lugs lid for engagement with the rear cap 12 to provide an axial lock. When inserted into the rear cap 12, the elastic retaining lugs lid bend inwards and then revert to the original state as they pass through the rear cap. Thereafter, the guide cylinder 11 and the rear cap 12 are rotatable but are locked axially, so are prevented from falling off.

Figure 11:
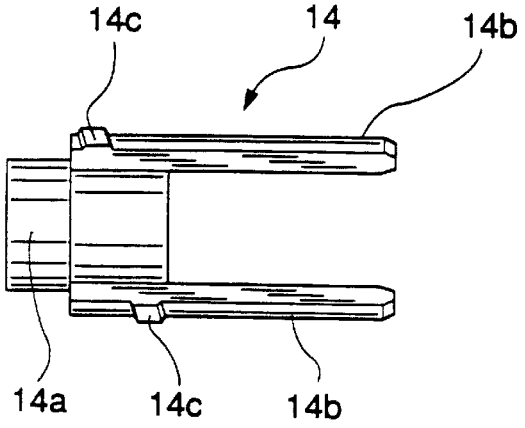
FIG. 11 is a side view of a slider illustrated in FIG. 10.
Figure 12:
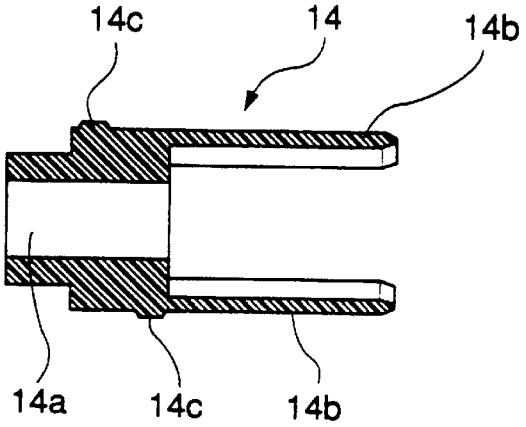
FIG. 12 is a longitudinal sectional view of the slider illustrated in FIG. 10.
Figure 10:
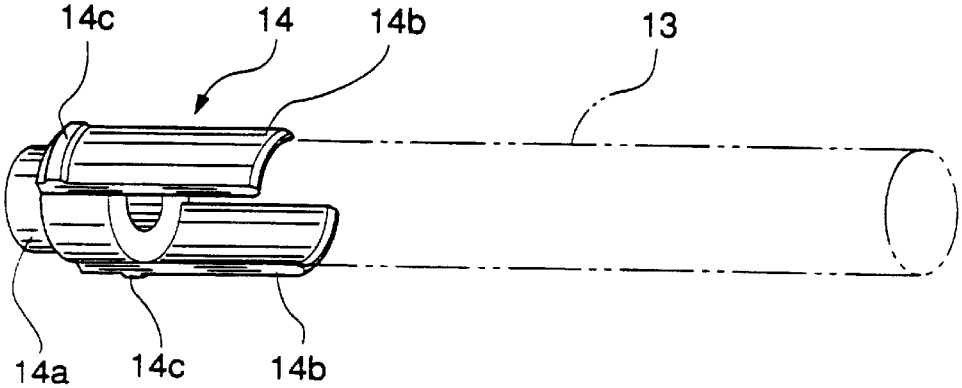
FIG. 10 is a perspective view of an eraser support member illustrated in FIG. 2.

Further, an eraser support member 14 which supports an eraser 13 is inserted axially slidably into the guide cylinder 11 and is engaged circumferentially with the guide cylinder. As shown in FIGS. 10 to 12, the eraser support member 14 is provided with a cylindrical body 14*a,* a pair of opposed arm portions 14*b* extending backward from the cylindrical body 14*a,* and a pair of inclined lugs 14*c* formed on the outer walls of the arm portions 14*b.* The inclined lugs 14*c* extend the slits 11*b* formed axially in the guide cylinder 11 and come into engagement with a spiral groove 12*a* formed in the inner periphery of the rear cap 12.

Figure 2:
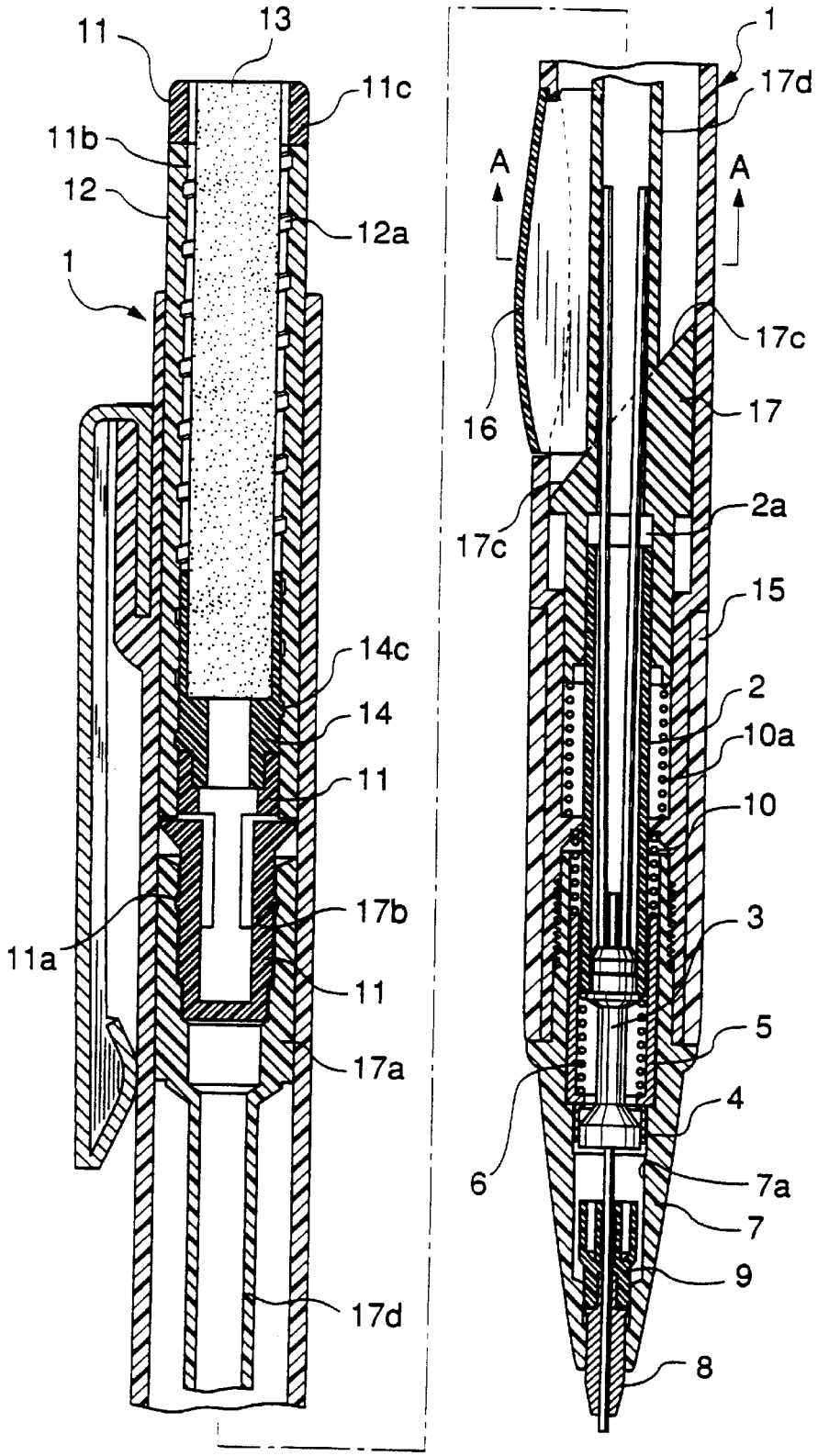
FIG. 2 is a longitudinal sectional view of a side knock type mechanical pencil according to embodiment 1 of the present invention.
Figure 3:
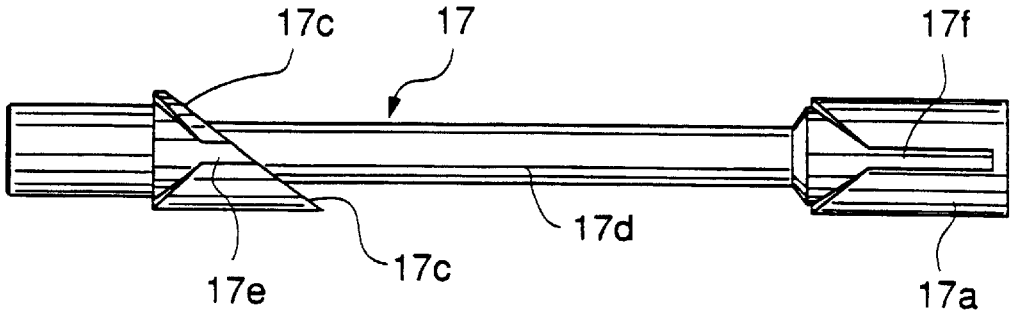
FIG. 3 is a side view of a slide member illustrated in FIG. 2.

As shown in FIG. 2, a grip member 15, e.g. rubber, is attached to the grip portion of the cylindrical shell 1. Behind the grip member 15, a knock lever 16 for side knock is mounted in a side wall portion of the cylindrical shell 1 so that it can be pushed axially. Inside corners of the front end of the knock lever 16 are in abutment with a slant face 17*c* of the slide member 17. More specifically, the slide member 17 has such a structure as shown in FIGS. 3 and 4. As illustrated therein, the slide member 17 is internally formed with a through hole 17*d* capable of receiving therein two or more leads at a time each 0.5 mm in diameter for example. The slide member 17 is formed with a large-diameter portion having the slant face 17*c* in a position opposed to the knock lever 16 when set in the mechanical pencil.

The slant face 17*c* is formed downward from the front toward the rear. When the knock lever 16 is depressed and comes into abutment with the slant face 17*c,* the slide member 17 is moved forward. In side faces of the slide member 17 are axially formed engaging grooves 17*e* for positioning, while in side faces of the receptacle portion 17*a* located at the rear there are formed engaging grooves 17*f* for swivel stop which come into engagement with ribs 1*a* (FIG. 6) formed on the inner periphery of the cylindrical shell 1.

As shown in FIG. 4, on the inner periphery of the rear receptacle portion 17*a* is formed a polygonal portion 17*g* which is, for example, octagonal in cross section and which comes into engagement with a polygonal portion 11*d* of the guide cylinder 11 to fulfill a swivel stop function.

Thus, according to this embodiment 1 there is given a technical consideration such that by connecting the writing mechanism located at the front and the eraser delivery mechanism located at the rear with each other it is made possible to effect not only side knock operation but also rear-end knock operation. In more particular terms, a rotating operation is required for pushing out the eraser 13 in the eraser delivery mechanism located at the rear. In this connection, if the rotation at the rear is transmitted to the front writing mechanism, it is impossible to effect the rotating operation due to idle running. To prevent such idle running, as mentioned above, the inside of the slide member 17 and that of the guide cylinder 11 are formed in a polygonal shape, e.g. octagonal shape, so as to permit sliding motion only in the axial direction.

According to embodiment 1, since rear-end knock is also possible, a lead can be easily pushed out little by little by side knock operation during writing. However, in order to start writing while a lead is still within the lead tank 2 and has not reached the tip pipe 8 yet, it is necessary to repeat knocking continuously for pushing out the retracted tip pipe 8 and lead. But the side knock operation is usually performed with the cylindrical shell 1 laid on its side, so the lead is difficult to come out even after release of the chuck 3. In this case, rear-end knock operation is most suitable which is performed in an upright state of the cylindrical shell 1. Besides, in the case of repeating knock continuously, rear-end knock is easier and superior in operability than side knock.

Figure 13A:
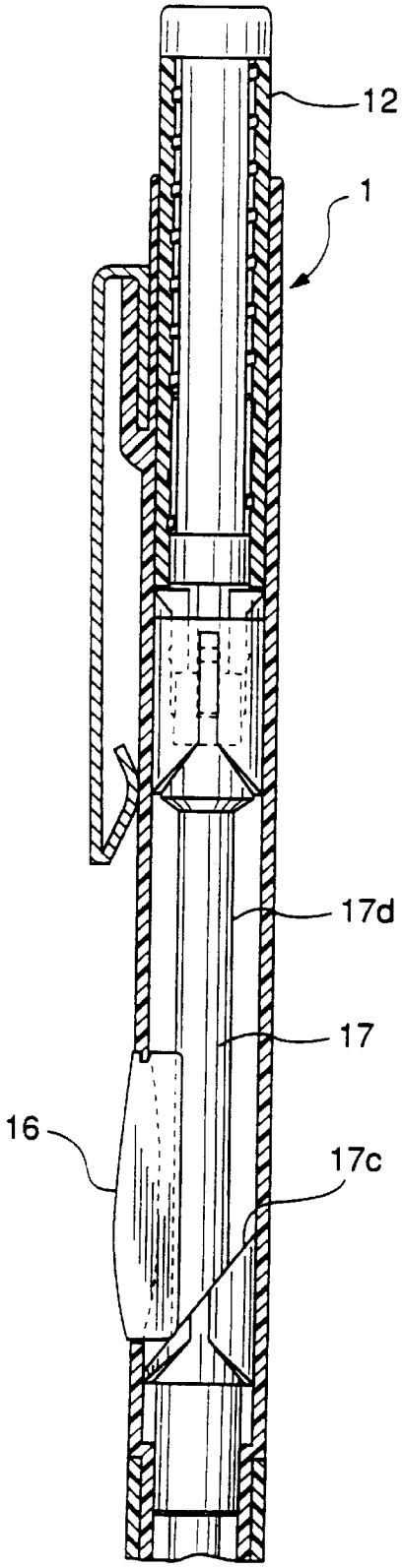
FIGS. 13(A) and 13(B) are longitudinal sectional views of a principal portion, showing a side knock operation in embodiment 1.
Figure 13B:
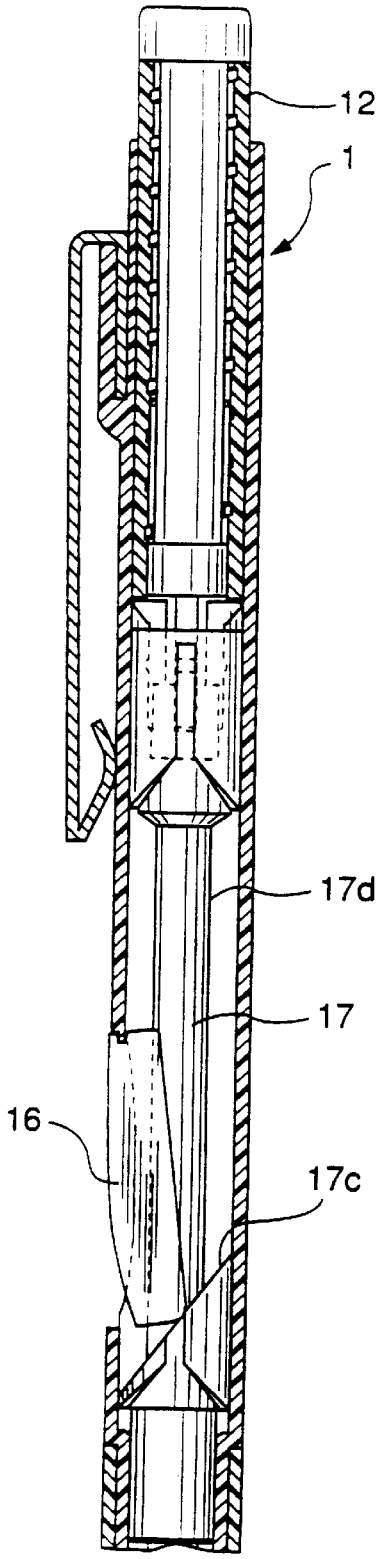

The operation of embodiment 1 constructed as above will now be described in detail with reference to FIG. 13. FIG. 13(A) shows a state before knock. In this state, when the side knock lever 16 is depressed for writing as shown in FIG. 14(B), inner corner portions of the front end of the knock lever 16 slide from above to below along the slant face 17*c* of the slide member 17, thereby pushing the slide member forward. As a result, the lead tank 2 and the chuck 3 are moved forward against the backward bias of the chuck spring 6. In the course of this forward movement, the chuck ring 4 loosely fitted on the chuck 3 comes into abutment with the stepped portion 7*a* of the inner periphery of the ferrule 7 and is disengaged thereby, while the slider 9 is moved forward by the chuck 3 and hence the tip pipe 8 is projected.

Upon release of the knock, the slide member 17 is returned backward by virtue of the chuck spring 6. Further, by repeating this knocking operation, the lead is pushed out to permit writing. After writing, by pushing the pencil tip lightly against the paper surface or pushing it lightly with a finger tip and subsequent knocking the knock lever 16, the chuck 3 is released and the lead and the tip pipe 8 are received into the ferrule 7.

The rear-end knock operation in this embodiment will now be described. When the rear end of the mechanical pencil is knocked with the pencil perpendicular to the paper surface, the eraser delivery mechanism is moved forward through the cylindrical shell 1 against the backward bias of the chuck spring 6. As a result, the components connected to this mechanism such as the slide member 17, lead tank 2 and chuck 3 are advanced, whereby a lead is pushed out in the same manner as in the foregoing side knock operation.

Figure 14A:
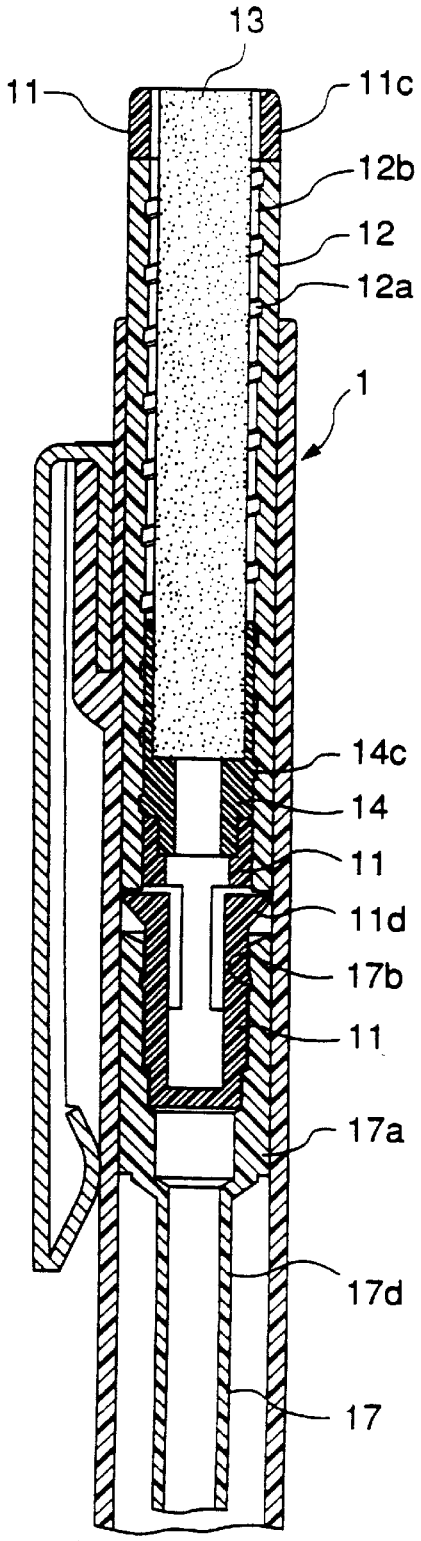
FIGS. 14(A) and 14(B) are longitudinal sectional views of a principal portion, showing an eraser delivery operation in embodiment 1.
Figure 14B:
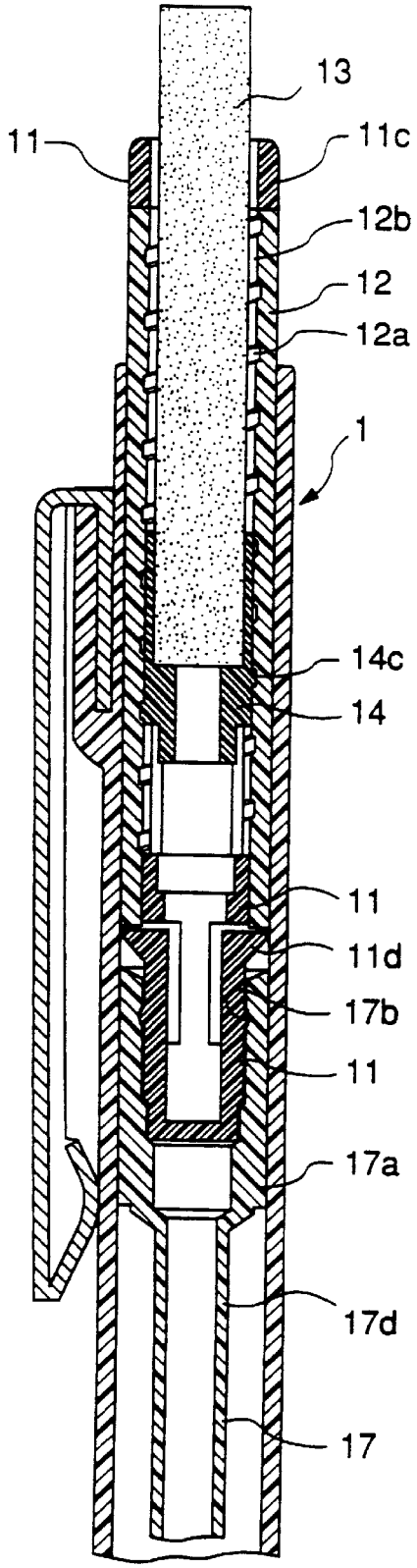

For pushing out the eraser in such a state as shown in FIG. 14(A), the rear cap 12 is rotated while the cylindrical shell 1 of the mechanical pencil body is fixed, with the result that the eraser support 14 rises through the guide cylinder 11. This is because the inclined lugs 14*c* of the eraser support member 14 are in engagement with the slits 11*b* of the guide cylinder 11. However, the guide cylinder 11 is swivel-stopped in combination with the slide member 17, which in turn is swivel-stopped in combination with the cylindrical shell 1. Therefore, as the inclined lugs 14*c* of the eraser support member 14 move axially upward through the slits 11*b* of the guide cylinder 11 along the spiral groove 12*a* formed in the inner periphery of the rear cap 12, with rotation of the rear cap, the eraser support member 14 comes to assume the state shown in FIG. 14(B).

In the case where a lead is to be newly fed, all the components of the eraser delivery mechanism positioned above the guide cylinder 11, except the slide member 17, can be removed as an independent unit by grasping and pulling out the rear cap 12. Thus, a plurality of leads can be fed at a time to the lead tank 2 from the receptacle portion 17*a* of the slide member 17.

Embodiment 2

Figure 16:
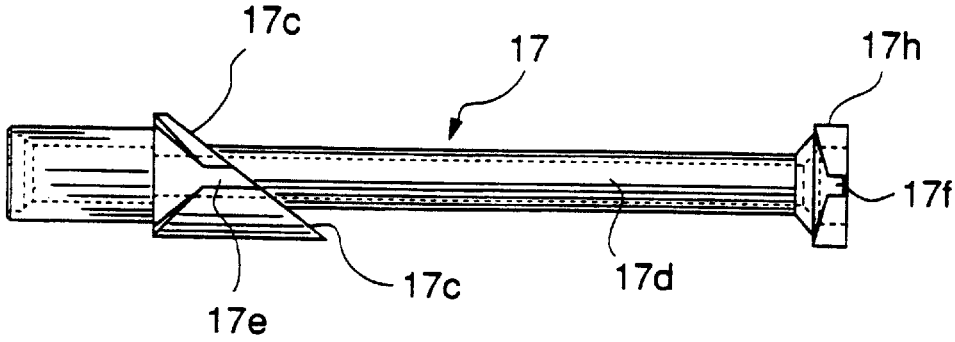
FIG. 16 is a side view of a slide member illustrated in FIG. 15.
Figure 15:
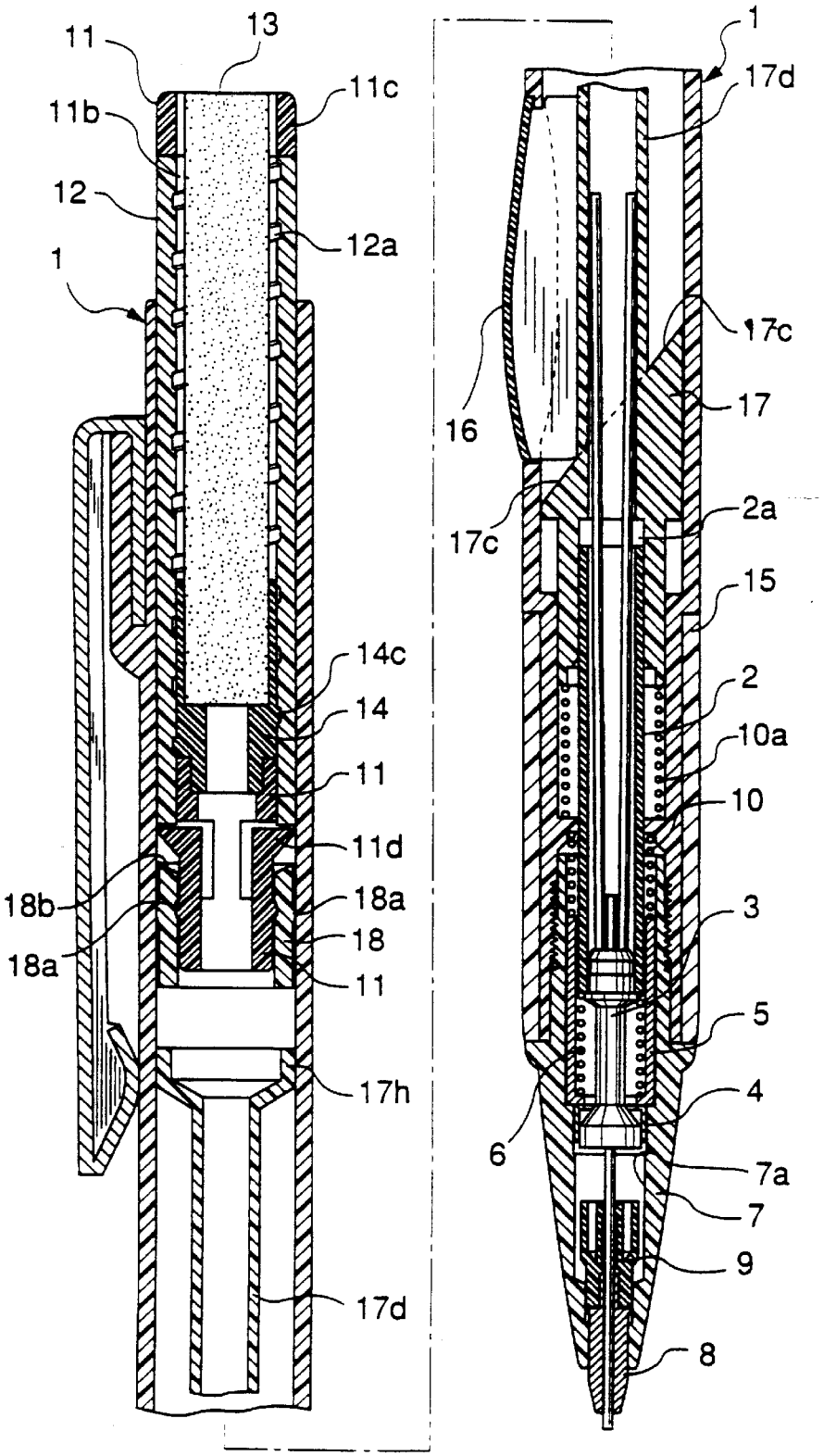
FIG. 15 is a longitudinal sectional view of a side knock type mechanical pencil according to embodiment 2 of the present invention.

Referring now to FIGS. 15 and 16, there is illustrated embodiment 2 of the present invention. In this embodiment, a tip pipe 8 and a lead can be pushed out by only side knock operation. According to this embodiment 2, since a slide member 17 and an eraser delivery mechanism located at the rear are structurally separated from each other, a writing mechanism located at the front and the eraser delivery mechanism located at the rear are completely independent of each other in point of function.

More specifically, a short guide portion 17*h* as guide means for the replenishment of new leads is integrally formed at the rear end of the slide member 17. Spacedly from the guide portion 17*h*, a stationary cylinder 18 is press-fitted and fixed strongly into a cylindrical shell 1. In more particular terms, on the outer periphery of the stationary cylinder 18 is formed an annular projection 18*a* having an upright portion at the rear end and also having a slant portion which declines gradually toward the front, when viewed in section. Therefore, when the stationary cylinder 18 is press-fitted into the cylindrical shell 1 strongly from the rear end, using a jig, the annular projection 18*a* collapses and the stationary cylinder 18 is completely fixed within the cylindrical shell.

A guide cylinder 11 is extractably engaged in the stationary cylinder 18, and the upper end of the cylinder 18 has a slant face 18*b* which is formed in the shape of a funnel so as to facilitate axial insertion of a lead. The other points of the eraser delivery mechanism are the same as in the previous embodiment 1. For the replenishment of leads, according to this embodiment 2, by pulling out the eraser delivery mechanism while grasping the large-diameter portion 11*c* or the rear cap 12 which are exposed at the rear of the guide cylinder 11, the whole of the unitized mechanism can be removed from the cylindrical shell 1 except the stationary cylinder 18 and hence it is possible to replenish leads easily.

In this embodiment 2, since the mechanical pencil mechanism located at the front and the eraser delivery mechanism located at the rear are completely independent of each other in point of function, it is not necessary to give such a technical consideration as that for preventing the rotating motion at the rear from being transmitted to the front. Further, since not only both mechanisms are completely independent of each other but also the mechanical pencil mechanism is securely held by the stationary cylinder 18 which is fixed strongly in the cylindrical shell 1, there is no fear of occurrence of such inconveniences as an erasing pressure being transmitted to the mechanical pencil mechanism, causing a lead to be pushed out unnecessarily, and slight retraction of the eraser.

Further, if the slide member 17 used in embodiment 2 is formed with engaging grooves 17*e* and 17*f* as shown in FIG. 16, and if engaging ribs 1*a* (FIG. 6) are formed in the inner periphery of the cylindrical shell 1 correspondingly to those grooves, the slide member 17 and the cylindrical shell 1 are mutually prevented from rotation. This is convenient. The slide member 17 has a backwardly descending slant face 17*c* in a position in which the slant face 17*c* come into opposition to a side knock member 16 provided in the cylindrical shell 1 when the slide member is mounted into the cylindrical shell. In assembling, therefore, by inserting the slide member 17 into the cylindrical shell 1 while conforming its engaging grooves 17*e* and 17*f* to the engaging ribs 1*a* of the cylindrical shell, the slide member can be set with high directionality. One of the engaging grooves 17*e* and 17*f* may be omitted if only the rotation preventing or positioning function can be attained. Further, even if engaging lugs are formed on the slide member 17 side in place of the engaging grooves 17*e* and 17*f* of the slide member and engaging grooves are formed in the inner periphery of the cylindrical shell 1 in corresponding relation thereto, there can be obtained the same effect as above.

Embodiment 3

Figure 17:
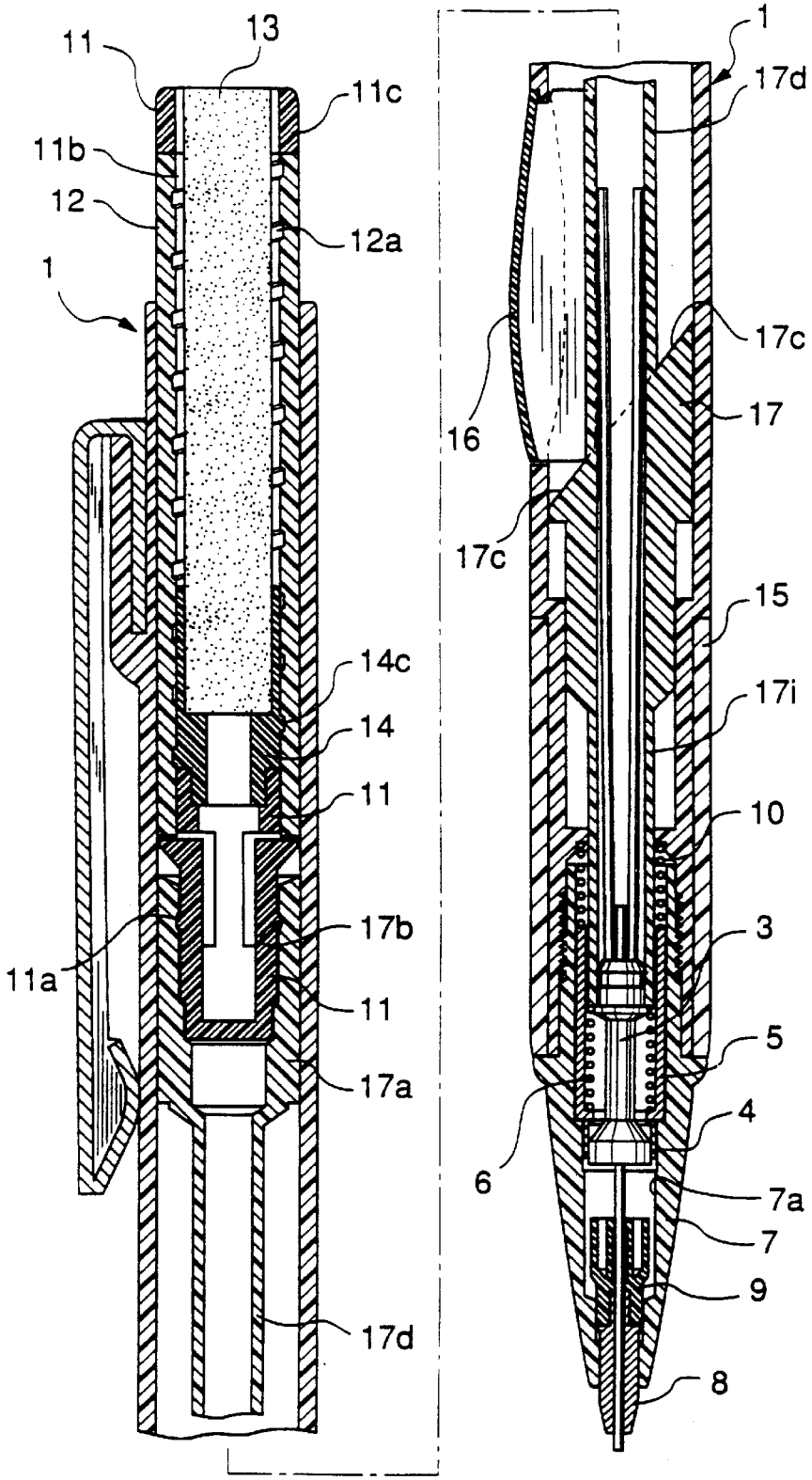
FIG. 17 is a longitudinal sectional view of a side knock type mechanical pencil according to embodiment 3 of the present invention.

Referring now to FIG. 17, there is illustrated embodiment 3 of the present invention. In this embodiment, both side knock and rear-end knock are possible, and there is used a slide member 17 of a one-piece structure. More specifically, the slide member 17 comprises a receptacle portion 17*a* located at the rear, an intermediate pipe 17*d* between the receptacle portion 17*a* and a slant portion 17*c* located at the front, and an extension 17*i* formed in front of the slant portion 17*c,* which components are formed integrally. A chuck 3 is press-fitted directly into the front end of the extension 17*i.* In this case, the return spring 10*a* used in the previous embodiments 1 and 2 may be omitted.

Embodiment 4

Figure 18:
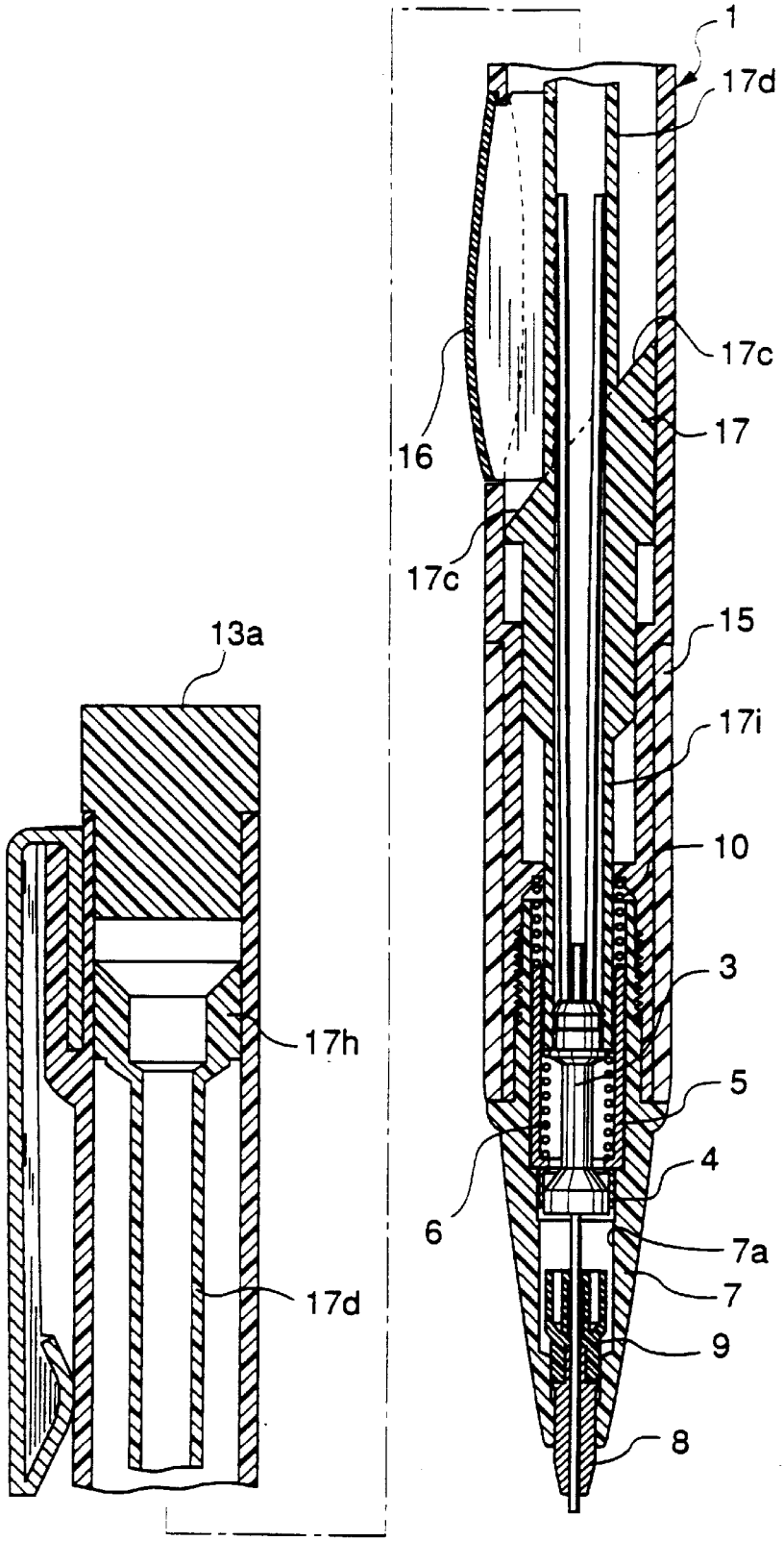
FIG. 18 is a longitudinal sectional view of a side knock type mechanical pencil according to embodiment 4 of the present invention.

Referring now to FIG. 18, there is illustrated embodiment 4 of the present invention. In this embodiment, only side knock operation is possible, the rear end portion of a slide member 17 is short, and an eraser delivery mechanism is not used. According to embodiment 4, since the whole of the mechanical pencil can be made fairly short, it is possible to obtain a mini-mechanical pencil. Numeral 13*a* in the figure denotes a short eraser which also serves as a cap.

Embodiment 5

Figure 19:
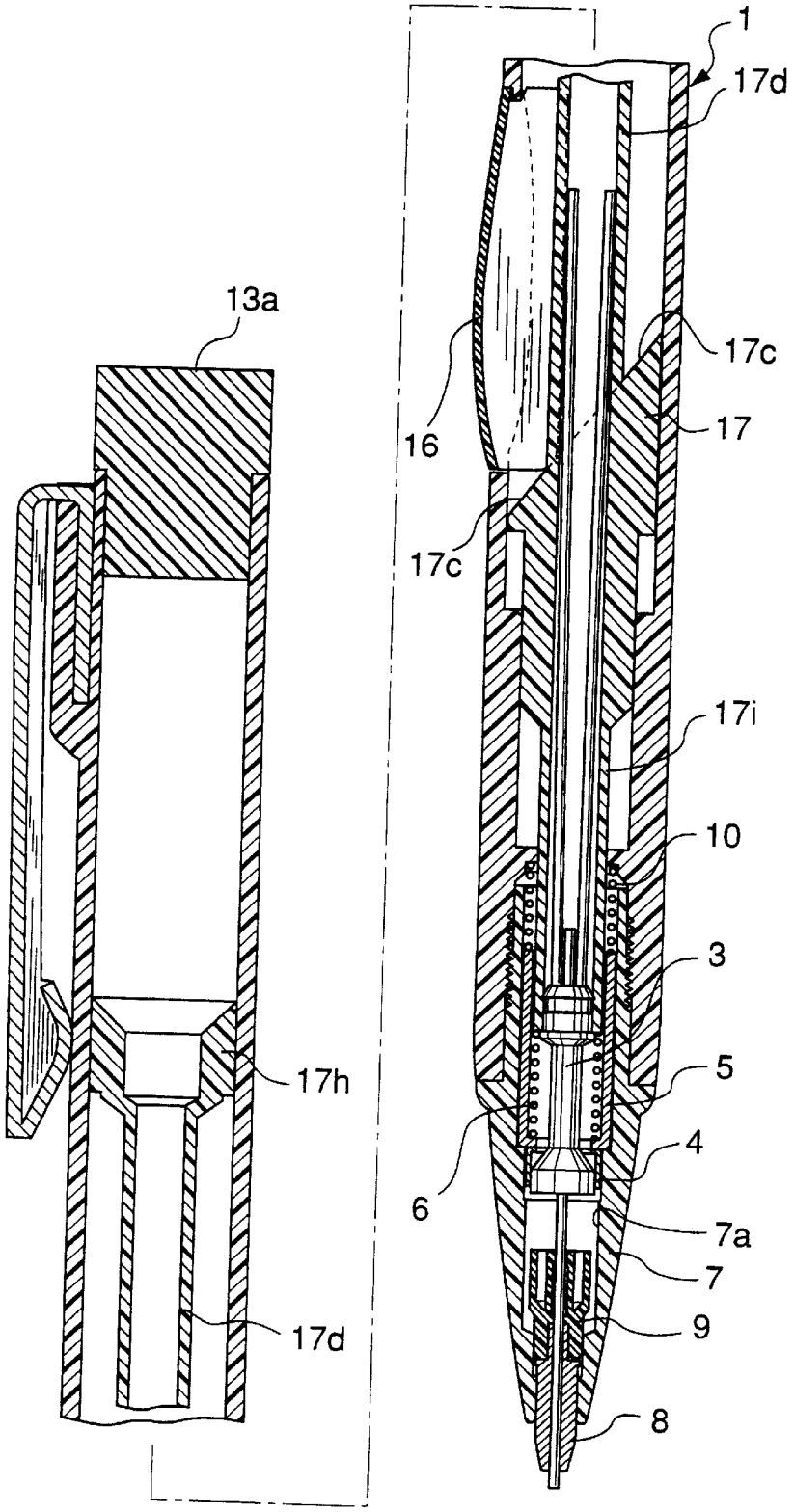
FIG. 19 is a longitudinal sectional view of a side knock type mechanical pencil according to embodiment 5 of the present invention.

Referring further to FIG. 19, there is illustrated embodiment 5 of the present invention. In this embodiment, only side knock operation is possible like embodiments 2 and 4. Besides, the grip member used in the previous embodiments 1 to 4 is omitted to minimize the number of components used.

Since the present invention is constructed as above, a sufficient space is ensured at the rear of a side knock type mechanical pencil, and it is possible to enlarge the inside diameter of the lead tank and that of the slide member, which are limited in length, so as to permit even spare leads to be received therein, and also possible to provide a grip member. Moreover, there is obtained a mechanical pencil having not only the side knock function but also a rear-end knock function so that a lead can be pushed out easily even in the initial continuous knocking though this is difficult in the side knock operation. Further, there is obtained a side knock type mechanical pencil having a reduced number of components, less expensive and easy to assemble, which are attained by using a slide member of a one-piece structure.

What is claimed is:

1. A side-knock mechanical pencil comprising:

a generally cylindrical barrel having an inner diameter;

a knock lever disposed within a side of said barrel;

chuck means disposed within said barrel to advance a pencil lead out of a front end of said barrel upon side-knock operation of said knock lever;

a generally elongated slide member disposed within said barrel in a manner to be axially movable relative to said barrel, said slide member being connected at a front end thereof to said chuck means and having a lead passageway communicating with said chuck means and a large-diameter portion serving as guide means for the replenishment of at least one pencil lead, said large-diameter portion having an outer diameter slightly smaller than the inner diameter of said barrel;

a biasing member disposed within said barrel to bias an assembly comprising said chuck means and said slide member backward; and means on said slide member contacting said knock lever for facilitating forward sliding of said assembly against the biasing action of said biasing member when said knock lever is pressed, said means on said slide member contacting said knock lever comprising a slanted portion having a surface that is angled relative to a longitudinal axis of said lead passageway.

2. The side-knock mechanical pencil of claim 1, wherein said slide member is formed as a one-piece member comprising said lead passageway, said large-diameter portion, and said slanted portion.

3. The side-knock mechanical pencil of claim 2, wherein said lead passageway is sized to permit a plurality of pencil leads to be disposed therein at the same time.

4. The side-knock mechanical pencil of claim 3, further including means mounted in a rear end of said barrel for selectively extending and retracting a rod-like object.

5. The side-knock mechanical pencil of claim 4, wherein said means for selectively extending and retracting a rod-like object is removably mounted in said rear end of said barrel.

6. The side-knock mechanical pencil of claim 5, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

7. The side-knock mechanical pencil of claim 6, further including cooperating means on said slide member and said barrel for preventing said slide member from being rotated relative to said barrel.

8. The side-knock mechanical pencil of claim 7, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

9. The side-knock mechanical pencil of claim 7, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

10. The side-knock mechanical pencil of claim 5, further including cooperating means on said slide member and said barrel for preventing said slide member from being rotated relative to said barrel.

11. The side-knock mechanical pencil of claim 10, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

12. The side-knock mechanical pencil of claim 10, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

13. The side-knock mechanical pencil of claim 4, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

14. The side-knock mechanical pencil of claim 13, further including cooperating means on said slide member and said barrel for preventing said slide member from being rotated relative to said barrel.

15. The side-knock mechanical pencil of claim 14, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

16. The side-knock mechanical pencil of claim 14, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

17. The side-knock mechanical pencil of claim 4, further including cooperating means on said slide member and said barrel for preventing said slide member from being rotated relative to said barrel.

18. The side-knock mechanical pencil of claim 17, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

19. The side-knock mechanical pencil of claim 17, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

20. The side-knock mechanical pencil of claim 3, further including cooperating means on said slide member and said barrel for preventing said slide member from being rotated relative to said barrel.

21. The side-knock mechanical pencil of claim 20, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

22. The side-knock mechanical pencil of claim 20, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

23. The side-knock mechanical pencil of claim 2, further including means mounted in a rear end of said barrel for selectively extending and retracting a rod-like object.

24. The side-knock mechanical pencil of claim 23, wherein said means for selectively extending and retracting a rod-like object is removably mounted in said rear end of said barrel.

25. The side-knock mechanical pencil of claim 24, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

26. The side-knock mechanical pencil of claim 25, further including cooperating means on said slide member and said barrel for preventing said slide member from being rotated relative to said barrel.

27. The side-knock mechanical pencil of claim 26, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

28. The side-knock mechanical pencil of claim 26, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

29. The side-knock mechanical pencil of claim 24, further including cooperating means on said slide member and said barrel for preventing said slide member from being rotated relative to said barrel.

30. The side-knock mechanical pencil of claim 29, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

31. The side-knock mechanical pencil of claim 29, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

32. The side-knock mechanical pencil of claim 23, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

33. The side-knock mechanical pencil of claim 32, further including cooperating means on said slide member and said barrel for preventing said slide member from being rotated relative to said barrel.

34. The side-knock mechanical pencil of claim 33, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

35. The side-knock mechanical pencil of claim 33, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

36. The side-knock mechanical pencil of claim 23, further including cooperating means on said slide member and said barrel for preventing said slide member from being rotated relative to said barrel.

37. The side-knock mechanical pencil of claim 36, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

38. The side-knock mechanical pencil of claim 36, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

39. The side-knock mechanical pencil of claim 2, further including cooperating means on said slide member and said barrel for preventing said slide member from being rotated relative to said barrel.

40. The side-knock mechanical pencil of claim 39, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

41. The side-knock mechanical pencil of claim 39, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

42. The side-knock mechanical pencil of claim 1, wherein said lead passageway is sized to permit a plurality of pencil leads to be disposed therein at the same time.

43. The side-knock mechanical pencil of claim 42, further including means mounted in a rear end of said barrel for selectively extending and retracting a rod-like object.

44. The side-knock mechanical pencil of claim 43, wherein said means for selectively extending and retracting a rod-like object is removably mounted in said rear end of said barrel.

45. The side-knock mechanical pencil of claim 44, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

46. The side-knock mechanical pencil of claim 45, further including cooperating means on said slide member and said barrel for preventing said slide member from being rotated relative to said barrel.

47. The side-knock mechanical pencil of claim 46, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

48. The side-knock mechanical pencil of claim 46, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

49. The side-knock mechanical pencil of claim 44, further including cooperating means on said slide member and said barrel for preventing said slide member from being rotated relative to said barrel.

50. The side-knock mechanical pencil of claim 49, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

51. The side-knock mechanical pencil of claim 49, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

52. The side-knock mechanical pencil of claim 43, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

53. The side-knock mechanical pencil of claim 52, further including cooperating means on said slide member and said barrel for preventing said slide member from being rotated relative to said barrel.

54. The side-knock mechanical pencil of claim 53, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

55. The side-knock mechanical pencil of claim 53, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

56. The side-knock mechanical pencil of claim 43, further including cooperating means on said slide member and said barrel for preventing said slide member from being rotated relative to said barrel.

57. The side-knock mechanical pencil of claim 56, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

58. The side-knock mechanical pencil of claim 56, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

59. The side-knock mechanical pencil of claim 42, further including cooperating means on said slide member and said barrel for preventing said slide member from being rotated relative to said barrel.

60. The side-knock mechanical pencil of claim 59, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

61. The side-knock mechanical pencil of claim 59, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

62. The side-knock mechanical pencil of claim 1, further including means mounted in a rear end of said barrel for selectively extending and retracting a rod-like object.

63. The side-knock mechanical pencil of claim 62, wherein said means for selectively extending and retracting a rod-like object is removably mounted in said rear end of said barrel.

64. The side-knock mechanical pencil of claim 63, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

65. The side-knock mechanical pencil of claim 64, further including cooperating means on said slide member and said barrel for preventing said slide member from being rotated relative to said barrel.

66. The side-knock mechanical pencil of claim 65, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

67. The side-knock mechanical pencil of claim 65, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

68. The side-knock mechanical pencil of claim 63, further including cooperating means on said slide member and said barrel for preventing said slide member from being rotated relative to said barrel.

69. The side-knock mechanical pencil of claim 68, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

70. The side-knock mechanical pencil of claim 68, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

71. The side-knock mechanical pencil of claim 62, wherein said means for selectively extending and retracting a rod-like object is mounted in said rear end of said barrel in a manner to be axially slidable relative to said barrel so that when said means for selectively extending and retracting a rod-like object is pushed, said assembly slides axially.

72. The side-knock mechanical pencil of claim 71, further including cooperating means on said slide member and said barrel for preventing said slide member from being rotated relative to said barrel.

73. The side-knock mechanical pencil of claim 72, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

74. The side-knock mechanical pencil of claim 72, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

75. The side-knock mechanical pencil of claim 62, further including cooperating means on said slide member and said barrel for preventing said slide member from being rotated relative to said barrel.

76. The side-knock mechanical pencil of claim 75, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

77. The side-knock mechanical pencil of claim 75, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

78. The side-knock mechanical pencil of claim 1, further including cooperating means on said slide member and said barrel for preventing said slide member from being rotated relative to said barrel.

79. The side-knock mechanical pencil of claim 78, wherein said cooperating means on said slide member and said barrel for preventing said slide member from being rotated relative to said barrel comprises a polygonal outer surface on said slide member and a polygonal inner surface on said barrel, said polygonal outer surface on said slide member being engaged with said polygonal inner surface on said barrel, thereby preventing said slide member from being rotated relative to said barrel.

80. The side-knock mechanical pencil of claim 78, wherein said cooperating means on said slide member and said barrel for preventing said slide member from being rotated relative to said barrel comprises projection means on one of said slide member and said barrel and groove means in the other of said slide member and said barrel, said projection means being engaged with said groove means, thereby preventing said slide member from being rotated relative to said barrel.

* * * * *